US006532632B1

(12) United States Patent
Halstead

(10) Patent No.: US 6,532,632 B1
(45) Date of Patent: Mar. 18, 2003

(54) BUCKLE

(76) Inventor: P. David Halstead, 941 Wildwood Gardens Dr., Knoxville, TN (US) 37920

( * ) Notice: Subject to any disclaimer, the term of this patent is extended or adjusted under 35 U.S.C. 154(b) by 0 days.

(21) Appl. No.: 09/870,334

(22) Filed: May 30, 2001

Related U.S. Application Data

(63) Continuation-in-part of application No. 09/861,424, filed on May 18, 2001, which is a continuation-in-part of application No. 09/778,471, filed on Feb. 7, 2001.

(51) Int. Cl.[7] ..... A44B 11/25; A44B 17/00; B60R 22/00

(52) U.S. Cl. ..... 24/309; 24/196; 24/198; 24/324; 24/615

(58) Field of Search ..... 24/309, 324, 305, 24/625, 615, 634, 198, 200, 196, 115 H

(56) References Cited

U.S. PATENT DOCUMENTS

| | | | | | |
|---|---|---|---|---|---|
| 871,981 | A | * | 11/1907 | Blum | 24/196 |
| 1,712,976 | A | * | 5/1929 | Blair | 24/324 |
| 1,753,696 | A | * | 4/1930 | Fenton | 24/324 |
| 1,889,322 | A | * | 11/1932 | Reiter | 24/324 |
| 1,902,557 | A | * | 3/1933 | Janes | 24/324 |
| 1,904,055 | A | * | 4/1933 | King | 24/324 |
| 2,292,899 | A | * | 8/1942 | Sanford | 24/198 |
| 2,800,697 | A | * | 7/1957 | Carpinella | 24/324 |
| 2,905,991 | A | * | 9/1959 | Reiter | 24/324 |
| 3,237,257 | A | * | 3/1966 | Forsberg | 24/324 |
| 3,336,639 | A | * | 8/1967 | Rutty et al. | 24/196 |
| 3,889,353 | A | | 6/1975 | Provi | |
| 3,977,839 | A | | 8/1976 | Palisin, Jr. | |
| 3,990,701 | A | | 11/1976 | Kim | |
| 4,177,320 | A | | 12/1979 | Yoshimura et al. | |
| 4,368,563 | A | * | 1/1983 | Lentz | 24/615 |
| 4,396,658 | A | | 8/1983 | Mettes et al. | |
| 4,628,004 | A | | 12/1986 | Nickola et al. | |
| 4,642,853 | A | * | 2/1987 | Plesniarski et al. | 24/198 |
| 4,944,530 | A | | 7/1990 | Spurrier | |
| 5,091,260 | A | | 2/1992 | Wong | |
| 5,242,714 | A | | 9/1993 | Steele et al. | |
| 5,259,096 | A | * | 11/1993 | Grant | 24/324 |
| 5,281,435 | A | | 1/1994 | Buecher | |
| 5,385,655 | A | | 1/1995 | Brent et al. | |
| 5,603,818 | A | | 2/1997 | Brent et al. | |
| 5,779,729 | A | | 7/1998 | Severini | |
| 5,974,637 | A | | 11/1999 | Tracy et al. | |

OTHER PUBLICATIONS

Silver Metal Buckle (3 pages).
Black Plastic Buckle (3 pages).
White Plastic Buckle (3 pages).

* cited by examiner

*Primary Examiner*—Victor Sakran
(74) *Attorney, Agent, or Firm*—Luedeka, Neely & Graham PC

(57) ABSTRACT

A buckle for receiving a strap member and for snap-fitting to a snap stud located on a helmet, the buckle including a metal member having opposite ends and opposite first and second substantially planar surfaces, with an aperture located between the ends and a slit on either side of the aperture, each of the slits including a plurality of rugous surfaces suitable for frictionally engaging a strap member positionable there through. A metal snap configured to be matingly engagable with the snap stud of the helmet is affixed adjacent to the first surface of the metal member by a fastener connectingly associated with the metal snap and the aperture of the metal member. A plastic material substantially encases the metal member except that at least a portion of the rugous surfaces and a portion of the first surface of the metal member adjacent the metal snap are not encased by the plastic material and remain exposed.

5 Claims, 9 Drawing Sheets

BUCKLE

CROSS-REFERENCE TO RELATED APPLICATION

This is a continuation-in-part application of pending U.S. patent application Ser. No. 09/861,424 filed May 18, 2001, and entitled BUCKLE, which is a continuation-in-part application of pending U.S. patent application Ser. No. 09/778,471 filed Feb. 7, 2001, and entitled BUCKLE (Allowed).

FIELD OF THE INVENTION

This invention relates generally to buckles. More particularly, this invention relates to a buckle of the type suitable for use with football helmet chin straps and which has improved corrosion resistance and strength properties as compared to conventional buckles.

BACKGROUND AND SUMMARY OF THE INVENTION

There is a need in the art for improved buckle for use with chin straps of helmets such as football helmets. Buckles of metal construction are known. Conventional metal buckles have shortcomings in that they are readily bent and are susceptible to corrosion. Plastic buckles are also known. While the plastic buckles are corrosion resistant, they are weak and susceptible to breakage.

Accordingly, the present invention is directed to a buckle for receiving a strap member and for snap-fitting to a snap stud located on a helmet. The buckle device is particularly suitable for use with chin straps of the type commonly used with football helmets.

In a preferred embodiment, the buckle includes a metal member having opposite ends and opposite first and second substantially planar surfaces, with an aperture located between the ends and a slit on either side of the aperture, each of the slits including a plurality of rugous surfaces suitable for frictionally engaging a strap member positionable there through. A metal snap configured to be matingly engageable with the snap stud of the helmet is affixed adjacent to the first surface of the metal member by a fastener connectingly associated with the metal snap. A plastic material substantially encases the metal member except that at least a portion of the rugous surfaces and a portion of the first surface of the metal member adjacent the metal snap ring are not encased by the plastic material and remain exposed.

BRIEF DESCRIPTION OF THE DRAWINGS

Further advantages of the invention will become apparent by reference to the detailed description of preferred embodiments when considered in conjunction with the figures, which are not to scale, wherein like reference numbers, indicate like elements through the several views, and wherein.

DETAILED DESCRIPTION

FIGS. 1–9*b*

Figure 1:
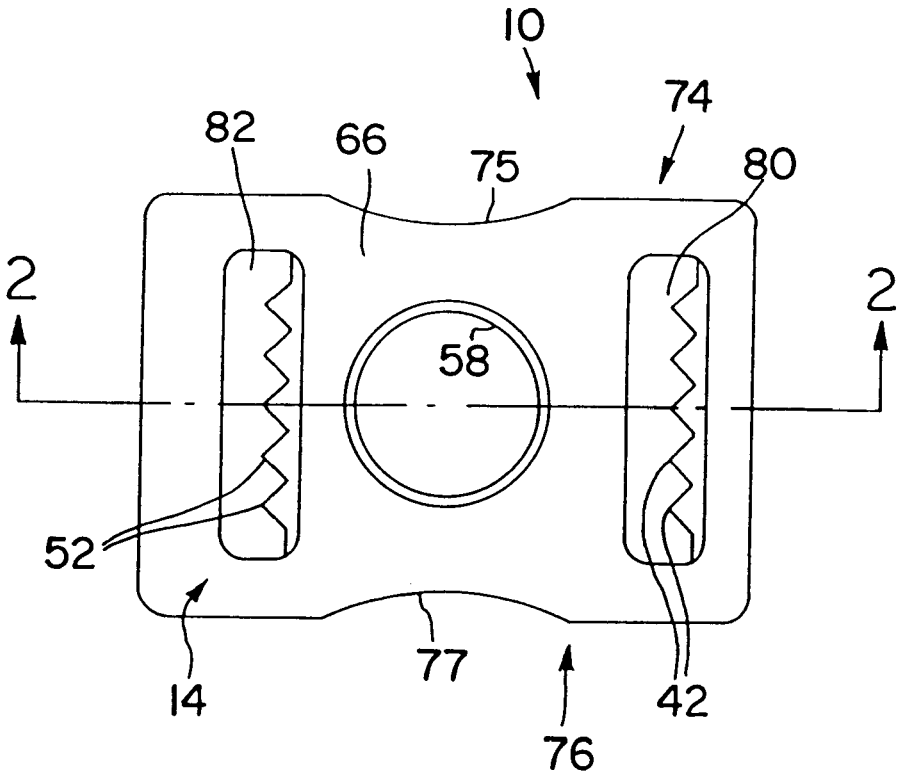
FIG. 1 is a top plan view showing a buckle in accordance with a preferred embodiment of the invention.
Figure 2:
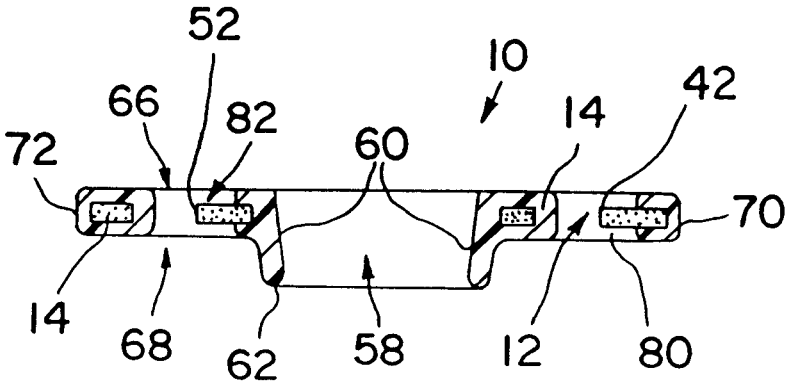
FIG. 2 is a cross-sectional view of the buckle of FIG. 1 taken along line 2—2.
Figure 3:
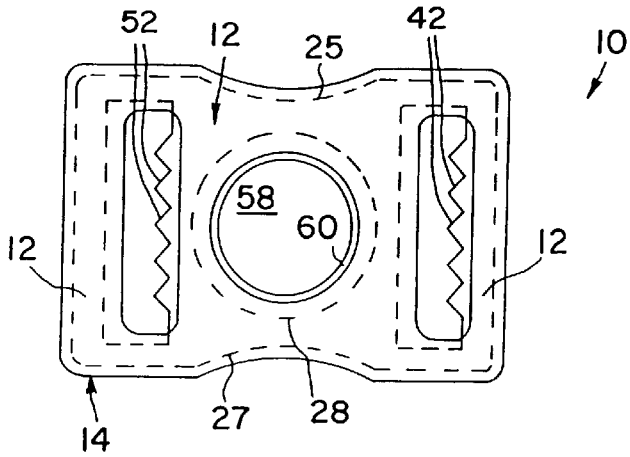
FIG. 3 is a top plan view of the buckle of FIG. 1 showing portions of a metal component of the buckle in phantom.
Figure 4:
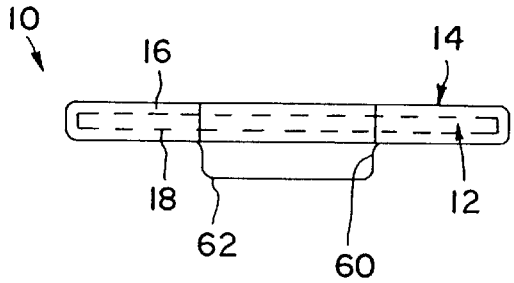
FIG. 4 is a side plan view of the buckle of FIG. 1 showing the metal component of the buckle in phantom.
Figure 5:
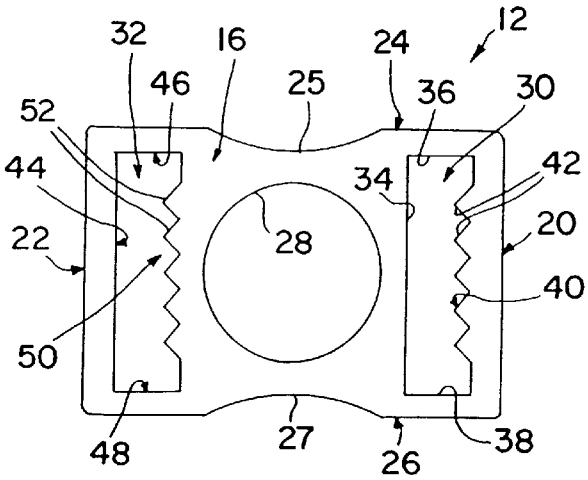
FIG. 5 is a top plan view of the metal component of the buckle of FIG. 1.

With reference to FIGS. 1-4, the invention relates to a buckle 10 that is particularly suitable for use with chin straps of sporting helmets, such as a football helmets. The buckle 10 includes a metal component 12 (FIG. 5) and a hard plastic component 14 partially encasing the metal component 12.

The metal component 12 is preferably of one piece, stamped steel construction, having a front surface 16 opposite a rear surface 18, opposite ends 20 and 22 and opposite sides 24 and 26, having slightly inwardly curved portions or indents 25 and 27, respectively. A substantially circular aperture 28 is centrally located and extends between the surfaces 16 and 18.

Slits 30 and 32 positioned adjacent the ends 20 and 22, respectively, extend between the surfaces 16 and 18 to permit passage of a strap member there through. The slit 30 is rectangular in cross-section, with smooth side 34 and smooth ends 36 and 38. Rugous side 40 is located adjacent the end 30 and includes a plurality of serrations or teeth 42 for frictionally engaging a portion of a strap member positioned through the slit 20. Similarly, the slit 32 includes smooth side 44 and smooth ends 46 and 48. Rugous side 50 is located adjacent the end 22 and includes a plurality of serrations or teeth 52 for frictionally engaging a portion of a strap member positioned through the slit 32.

Figure 6A:
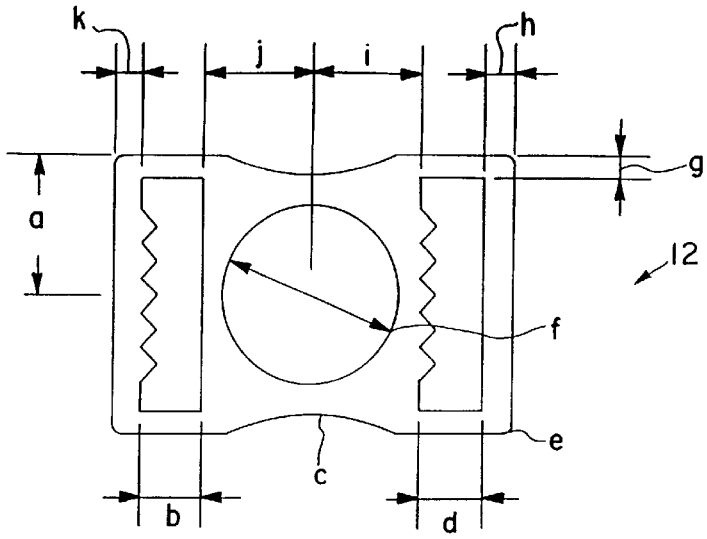
FIGS. 6*a*–6*c* show preferred dimensions of the metal component of the buckle of FIG. 1.
Figure 6B:
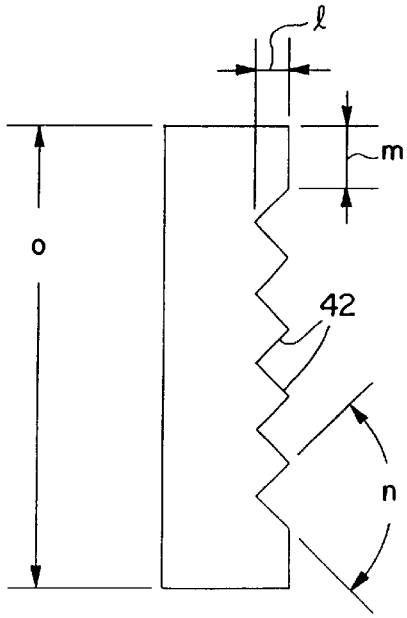
Figure 6C:
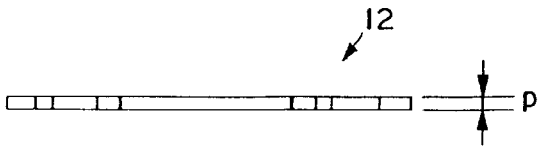
Figure 7:
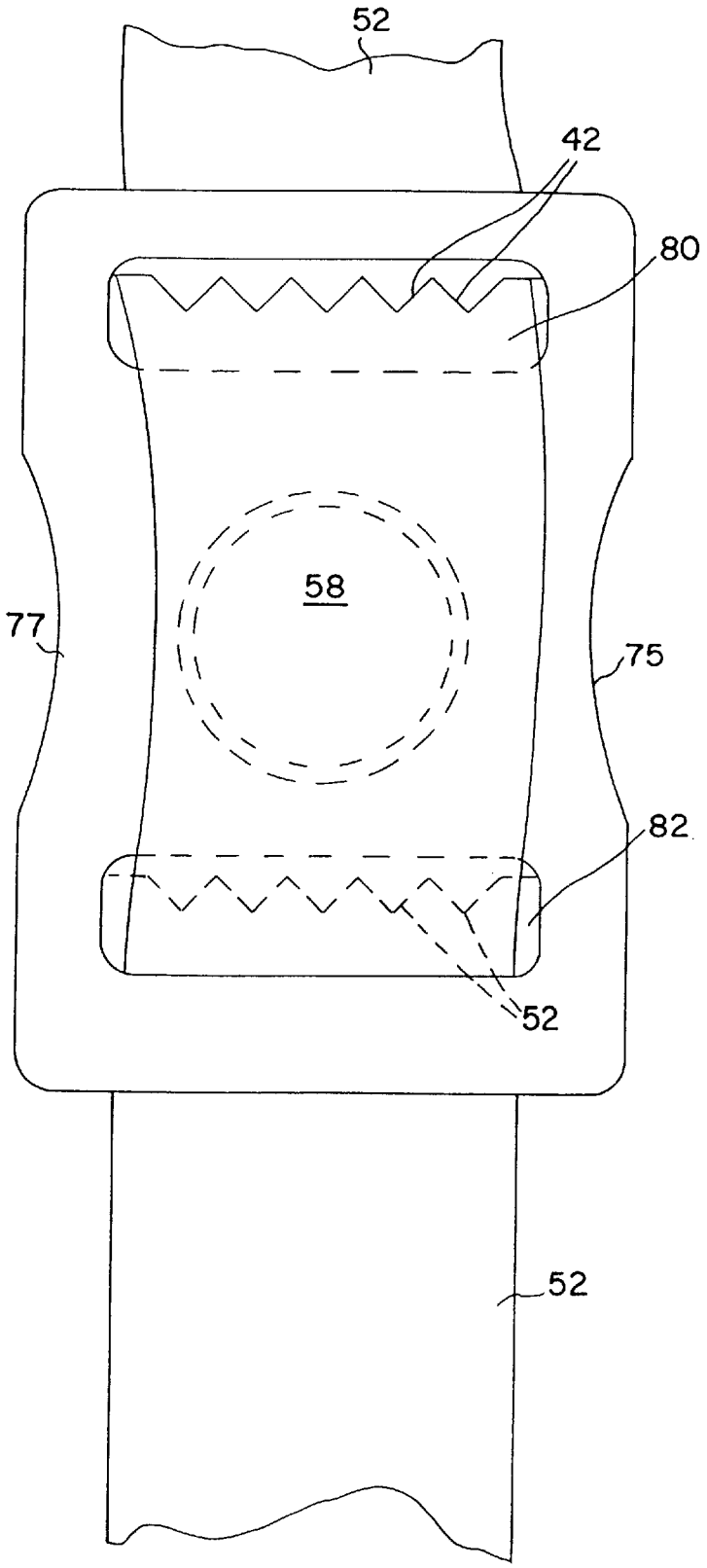
FIG. 7 is a perspective view showing the buckle of FIG. 1 installed on a strap and ready for fastening onto a helmet.

With reference to FIGS. 6*a*–*c* and Chart 1, there is provided an example of preferred dimensions of the metal component 12:

CHART 1

| Reference letter | Dimension (inches unless specified) |
|---|---|
| a | 0.4 |
| b | 0.188 |
| c | 0.62 (radius) |
| d | 0.188 |
| e | 0.025 (radius) |
| f | 0.524 |
| g | 0.063 |
| h | 0.088 |
| i | 0.325 |
| j | 0.325 |
| k | 0.088 |
| l | 0.05 |
| m | 0.087 |
| n | 90 degrees |
| o | 0.675 |
| p | 0.04 |

The hard plastic component 14 is preferably provided by a polymer such as a polycarbonate or a glass-filled nylon. The buckle 10 may be manufactured by placing the metal component 12 in a mold configured to provide the herein described plastic component 14 and introducing molten plastic to partially encase the metal component 12.

The hard plastic component 14 substantially encases the metal component 12, except that the rugous sides 40 and 50 (and hence the teeth or serrations 42, 52) are not encased by the plastic component 14 and remain exposed so that they can engage portions of a strap 52 (FIG. 7) placed through the slits 30 and 32, and a region surrounding the aperture 28 is not encased and defines a barrel 58 located adjacent the aperture 28 for receiving and mating in a snap-fit relationship with a conventional snap-stud fastener of the type used with metal buckles and located on a helmet with which the buckle 10 is to be used.

Figure 9A:
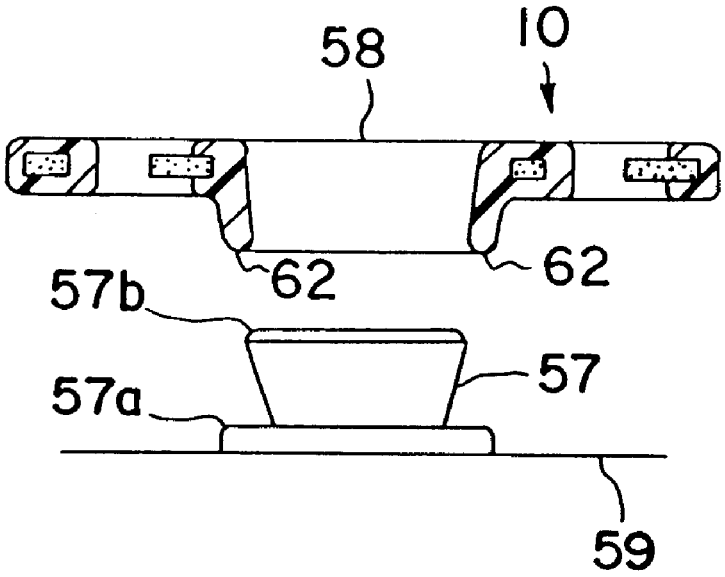
FIGS. 9*a* and 9*b* show fitting of the buckle of FIG. 1 onto a snap stud.
Figure 9B:
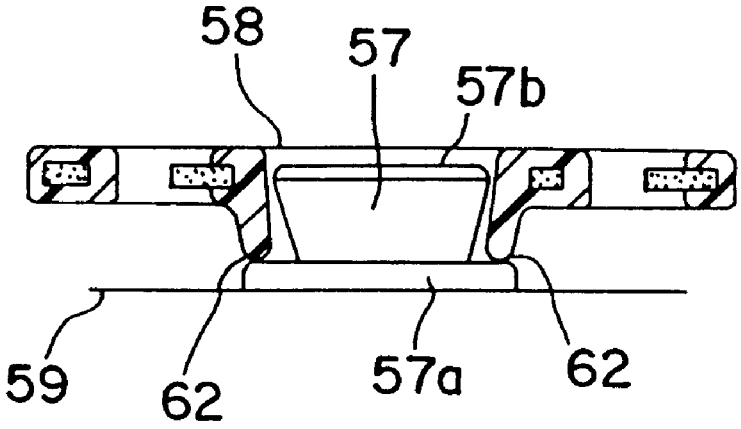
Figure 10:
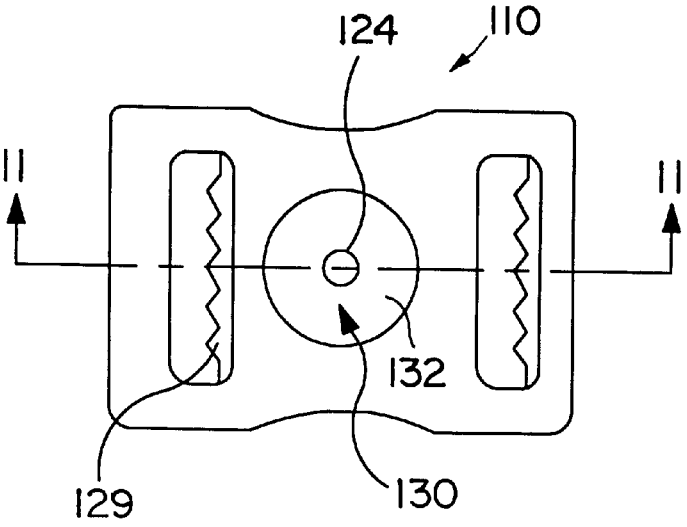
FIG. 10 is a top plan view showing a buckle in accordance with an alternative embodiment of the invention.

For example, with reference to FIGS. 9*a* and 9*b,* the barrel 58 is positionable to receive a snap stud 57 located on helmet shell 59. As will be noted, the sidewall 60 of the barrel 58 is preferably sloped so that the radius of the sidewall 60 increases in a direction away from lower end 62 of the barrel which is the end that is positioned over the snap-stud fastener 57 and lower end 62 rests on a lower circular ridge 57*a* of the stud 57. The lower end 62 of the barrel 58 is sized just slightly smaller than an upper circular ridge 57*b* at the upper end of the fastener 57 so that when the barrel 58 is urged over the fastener 57 a snap-fit results.

Accordingly, the resulting buckle 10 includes a front surface 66 opposite a rear surface 68, opposite ends 70 and 72 and opposite sides 74 and 76, having slightly inwardly curved portions or indents 75 and 77. The barrel 58 is centrally located so that it is coaxial with the aperture 28 and extends between the surfaces 66 and 68. Slits 80 and 82 are adjacent the slits 30 and 32 of the metal components 12 are adjacent the ends 70 and 72 to permit passage of the strap member 52.

Figure 8A:
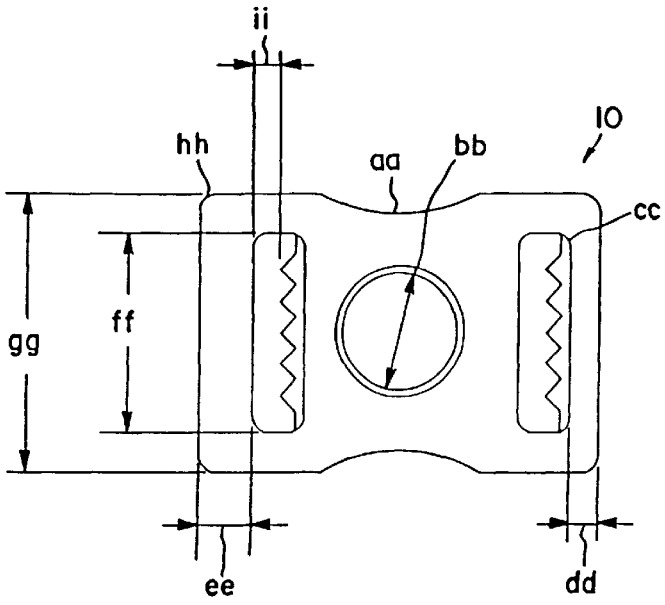
FIGS. 8*a*, 8*b* and 8*c* show preferred dimensions of the buckle of FIG. 1 and of the plastic component of the buckle of FIG. 1.
Figure 8B:
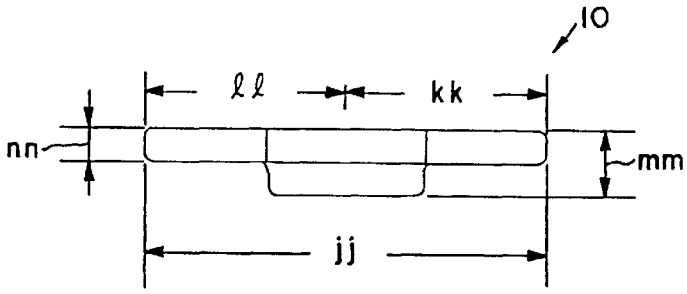
Figure 8C:
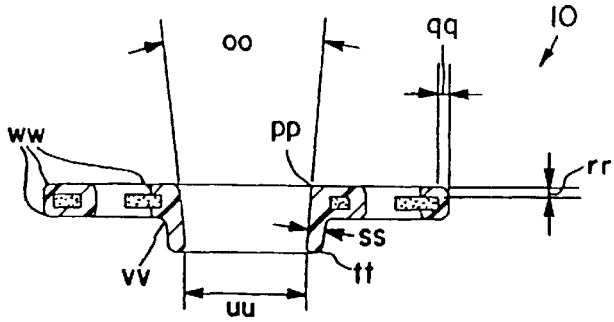

With reference to FIGS. 8*a*–8*c* and Chart 2, there is provided an example of preferred dimensions of the buckle 10 and of the plastic component 14:

CHART 2

| Reference letter | Dimension (inches unless specified) |
|---|---|
| aa | 0.592 (radius) |
| bb | 0.38 |
| cc | 0.056 (radius) |

CHART 2-continued

| Reference letter | Dimension (inches unless specified) |
|---|---|
| dd | 0.094 |
| ee | 0.169 |
| ff | 0.625 |
| gg | 0.862 |
| hh | 0.056 (radius) |
| ii | 0.088 |
| jj | 1.26 |
| kk | 0.631 |
| ll | 0.631 |
| mm | 0.20 |
| nn | 0.102 |
| oo | 11 degrees |
| pp | 0.025 (radius) |
| qq | 0.031 |
| rr | 0.031 |
| ss | 0.050 |
| tt | 0.025 (radius) |
| uu | 0.38 |
| vv | 0.025 (radius) |
| ww | 0.031 (radius) |

FIGS. 10–15

With reference now to FIGS. 10–15, there is shown another embodiment of a buckle 110 that is particularly suitable for use with chin straps of sporting helmets, such as a football helmets. The buckle 110 includes a metal component 112 (FIG. 13), a hard plastic component 114 partially encasing the metal component 112, a metal snap 116 for receiving and mating with a conventional snap-stud fastener, and a fastener, such as pop rivet 118 with head 120 and shaft 122 to fasten metal snap 116 to metal component 112. As will be appreciated, the shaft 122 snaps or pops off as the rivet is deformed during installation.

Figure 11:
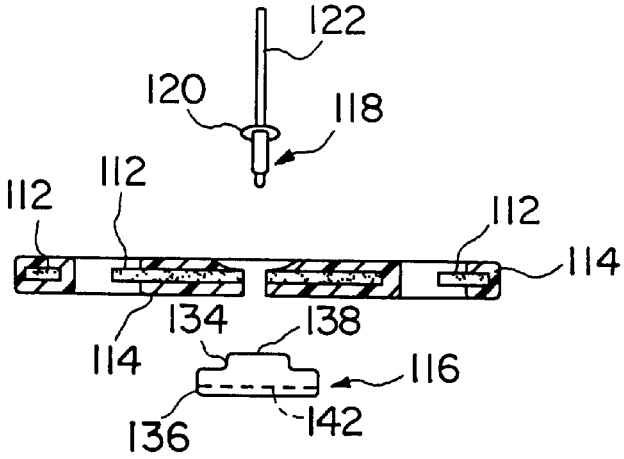
FIG. 11 is a cross-sectional view of the buckle of FIG. 10 taken along line 11—11.
Figure 13:
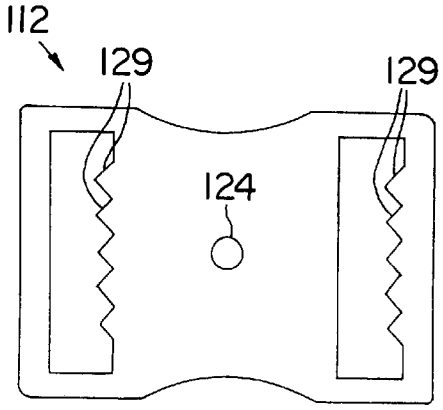
FIG. 13 is a top plan view of the metal component of the buckle of FIG. 10.
Figure 14:
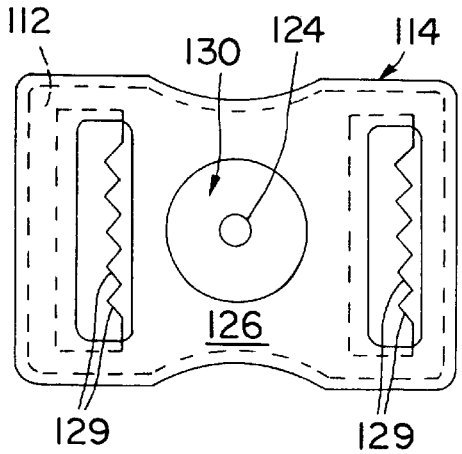
FIG. 14 is a top plan view of the buckle of FIG. 10 showing portions of a metal component of the buckle in phantom.
Figure 15:
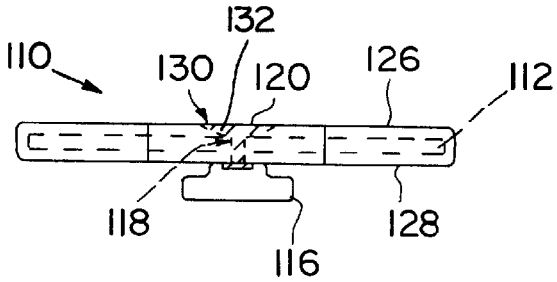
FIG. 15 is a side plan view of the buckle of FIG. 10 showing the metal component of the buckle in phantom.

With reference to FIG. 13, the metal component 112 is preferably substantially identical to previously described metal component 12, except that the size of the aperture there through is smaller. In this regard, it is noted that a circular aperture 124 is centrally located and extends between front surface 126 and opposite rear surface 128. The aperture 124 is preferably sized to permit passage of a shaft 122 of a rivet 118, but not head 120 of the rivet 118 (FIG. 11).

The hard plastic component 114 substantially encases the metal component 112 preferably in the same manner as previously described plastic component 14 encases metal component 12. The hard plastic component 114 is preferably provided by a polymer such as a polycarbonate or a glass-filled nylon. The buckle 110 may be manufactured by placing the metal component 112 in a mold configured to provide the herein described plastic component 114 and introducing molten plastic to partially encase the metal component 112.

Similarly to plastic component 14 encasing metal component 12, the hard plastic component 114 substantially encases the metal component 112 except that the rugous sides such as teeth or serrations 129 of the metal component 112 are not encased by the plastic component 114 and remain exposed so that they can engage portions of a strap. A bowl shaped indentation 130 is defined on surface 132 of the plastic component 114 and is located so as to surround the aperture 124. The indentation 130 is configured for receiving head 120 of rivet 118 in the assembled buckle so as to provide the finished buckle with a substantially flat profile on that side.

The metal snap 116 is configured for receiving and mating in a snap-fit relationship with a conventional snap-stud fastener of the type used with metal buckles and located on a helmet with which the buckle 110 is to be used. The metal snap 116 is attached to the buckle with a fastener such as the rivet 118.

Figure 12A:
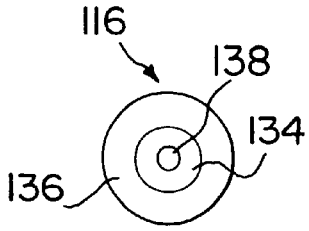
FIG. 12*a* is a top view of the metal snap component for the buckle of FIG 10.
Figure 12B:
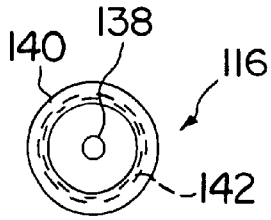
FIG. 12*b* is a bottom view of the metal snap component for the buckle of FIG. 10 showing the split ring component in phantom.

With reference to FIGS. 12*a* and 12*b,* which are top and bottom plan view of the snap 116, respectively, the snap is substantially.bell-shaped having a narrow top end 134 opposite flared open end 136. An aperture 138 is defined through the end 134 and corresponds in dimension to aperture 124 of metal component 112 and is positioned during installation so as to be concentric with aperture 124. An annular rim 140 is defined adjacent the flared end 136 for receiving a split ring 142. The rim 140 and ring 142 cooperate in a snap-fit relationship with a snap stud for connection of the buckle to the snap stud.

FIGS. 16–18

Figure 16:
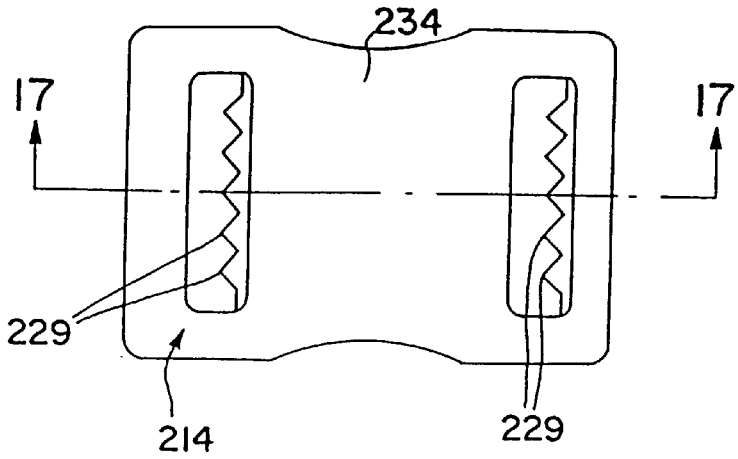
FIG. 16 is a top plan view showing a buckle in accordance with another embodiment of the invention.
Figure 17:
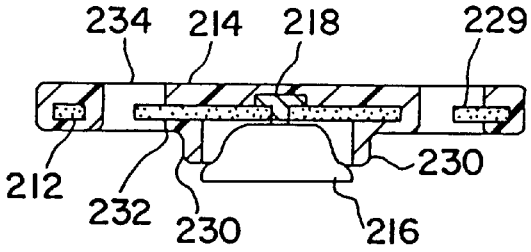
FIG. 17 is a cross-sectional view of the buckle of FIG. 16 taken along line 17—17.
Figure 18:
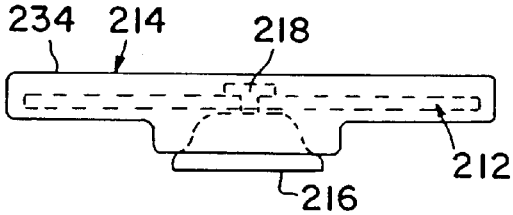
FIG. 18 is a side plan view of the buckle of FIG. 16.

With reference now to FIGS. 16–18, there is shown another embodiment of a buckle 210 that is particularly suitable for use with chin straps of sporting helmets, such as a football helmets. The buckle 210 includes a metal component 212, a hard plastic component 214 partially encasing the metal component 112, a metal snap 216 for receiving and mating with a conventional snap-stud fastener, and a fastener, such as pop rivet 218 to fasten metal snap 216 to metal component 212.

The metal component 212 is preferably substantially identical to previously described metal component 112 (FIG. 13).

The hard plastic component 214 substantially encases the metal component 212 preferably in the same manner as previously described. The hard plastic component 214 is preferably provided by a polymer such as a polycarbonate or a glass-filled nylon.

The buckle 210 may be manufactured by first attaching the metal snap 216 to the metal component 212 with the fastener 218 and then placing the metal component 212 in a mold configured to provide the herein described plastic component 214 and introducing molten plastic to partially encase the metal component 212 and the snap ring 216. The snap ring 216 and the fastener 218 are preferably identical to the snap ring 116 and fastener 118 previously described.

Similarly to the previously described embodiments, the hard plastic component 214 substantially encases the metal component 212 except that the rugous sides such as teeth or serrations 229 of the metal component 212 are not encased by the plastic component 114 and remain exposed so that they can engage portions of a strap. A wall 230 is defined on a portion of lower surface 232 of the plastic component 214 and is located so as to substantially surround the snap ring 216, except that the snap ring 216 preferably extends slightly below the wall 230 and the wall 230 is preferably spaced at least slightly away from the snap ring. A substantially uniform planar upper surface 234 of the buckle 210 is provided by the plastic component 214.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A buckle for receiving a strap member and for snap-fitting to a snap stud located on a helmet, the buckle comprising:

a metal member having opposite ends and opposite first and second substantially planar surfaces, with an aperture located between the ends and a slit on either side of the aperture, each of the slits including a plurality of rugous surfaces suitable for frictionally engaging a strap member positionable there through, a metal snap configured to be matingly engagable with the snap stud of the helmet and affixed adjacent to the first surface of the metal member by a fastener connectingly associated with the metal snap and the aperture of the metal member, and a plastic material substantially encasing the metal member except that at least a portion of the rugous surfaces and a portion of the first surface of the metal member adjacent the metal snap are not encased by the plastic material and remain exposed.

2. The buckle of claim 1, wherein the rugous surfaces comprise a plurality of serrations.

3. The buckle of claim 1, wherein the fastener is a rivet.

4. The buckle of claim 1, wherein the plastic material comprises a glass filled nylon.

5. The buckle of claim 1, wherein a portion of the plastic material adjacent the metal snap defines a wall substantially surrounding at least a portion of the metal snap.

* * * * *